US006093524A

United States Patent [19]

Scheerer et al.

[11] Patent Number: 6,093,524

[45] Date of Patent: Jul. 25, 2000

[54] COLOR PHOTOGRAPHIC FILM

[75] Inventors: Rainer Scheerer, Köln; Lothar Endres, Bergisch Gladbach; Hans-Ulrich Borst, Elsdorf; Lydia Simon, Wülfrath; Thomas Stetzer, Langenfeld; Peter Bell; Lothar Rosenhahn, both of Köln; Ralf Büscher, Lohmar, all of Germany

[73] Assignee: Agfa-Gevaert NV, Belgium

[21] Appl. No.: 09/153,180

[22] Filed: Sep. 16, 1998

[30] Foreign Application Priority Data

Sep. 23, 1997 [DE] Germany ..... 197 41 845
Feb. 5, 1998 [DE] Germany ..... 198 04 555

[51] Int. Cl.[7] ..... G03C 1/46

[52] U.S. Cl. ..... 430/505; 430/506; 430/567

[58] Field of Search ..... 430/505, 506, 430/567

[56] References Cited

U.S. PATENT DOCUMENTS 4,594,317 6/1986 Sasaki et al. ..... 430/567
4,952,491 8/1990 Nishikawa et al. ..... 430/567
5,272,048 12/1993 Kim et al. ..... 430/567

*Primary Examiner*—Geraldine Letscher
*Attorney, Agent, or Firm*—Connolly Bove Lodge & Hutz LLP

[57] ABSTRACT

A color photographic film having a support, 2 or 3 red-sensitive, cyan-coupling silver halide emulsion layers, 2 or 3 green-sensitive, magenta-coupling silver halide emulsion layers, 2 or 3 blue-sensitive, yellow-coupling silver halide emulsion layers, conventional interlayers and protective layers together with a yellow filter layer arranged closer to the support than the blue-sensitive layers, wherein at least one green-sensitive silver halide emulsion layer is arranged further away from the support than all the other photosensitive layers, exhibits improved sharpness without color distortion if at least 50% of the projected surface area of the silver halide emulsion of the green-sensitive silver halide emulsion layer, of which there is at least one, consists of tabular silver halide grains having an aspect ratio of at least 3.

8 Claims, No Drawings

COLOR PHOTOGRAPHIC FILM

This invention relates to a colour photographic film having a sensitivity of at least ISO 50.

Colour photographic films such as colour negative films and colour reversal films have on the support, in the sequence stated below, 2 or 3 red-sensitive, cyan-coupling silver halide emulsion layers, 2 or 3 green-sensitive, magenta-coupling silver halide emulsion layers and 2 or 3 blue-sensitive, yellow-coupling silver halide emulsion layers. The layers of identical spectral sensitivity differ with regard to the photographic sensitivity thereof, wherein the less sensitive sub-layers are generally arranged closer to the support than the more highly sensitive sub-layers.

A yellow filter layer is conventionally arranged between the green-sensitive and blue-sensitive layers to prevent blue light from reaching the underlying layers.

This is necessary because the red- and green-sensitive silver halide emulsions also exhibit an intrinsic sensitivity to blue which results in distorted colour reproduction if the blue light is not absorbed by the yellow filter layer.

It is desirable to arrange at least one green-sensitive layer further away from the support than all the other photosensitive layers as this would be associated with an increase in sharpness because the green sub-image is more important to perceived sharpness than the other sub-images. However, the above-stated problem of colour distortion then occurs.

The object of the invention was accordingly to provide a colour photographic film which exhibits no colour distortion while achieving improved sharpness.

This object is surprisingly achieved with a colour photographic film in which at least one green-sensitive sub-layer is arranged further from the support than all the other photosensitive layers if the stated green-sensitive layer has tabular silver halide crystals.

The present invention accordingly provides a colour photographic film of the above-stated type in which at least one green-sensitive silver halide emulsion layer is arranged further away from the support than all the other photosensitive layers, in particular is arranged further away from the support than all the blue- and red-sensitive silver halide emulsion layers, characterised in that at least 50%, in particular at least 70% of the projected surface area of the silver halide emulsion of the green-sensitive silver halide emulsion layer, of which there is at least one, consists of tabular silver halide grains having an aspect ratio of at least 3, in particular, 5 to 15.

Hexagonal tabular crystals having an adjacent edge ratio of between 2:1 and 1:1 are particularly preferred.

Emulsions having crystals with a narrow grain size distribution are also preferred. The distribution range V of an emulsion is defined as:

$$V(\%) = \frac{\text{standard deviation of grain size distribution}}{\text{average grain size}} \cdot 100$$

Values of ≦25% are preferred, with those of ≦20% being particularly preferred. The principal projected surface areas of the crystals may be of the [111] type and [100] type.

Silver halides which are preferably considered are AgBrI and AgBrClI containing up to 15 mol. % iodide and up to 20 mol. % chloride.

Details concerning production, chemical ripening, stabilisation and spectral sensitisation, including suitable spectral sensitisers, may be found inter alia in *Research Disclosure* 37265, part 3 (1995), page 286 and *Research Disclosure* 37038, part XV (1995), page 89.

In a preferred embodiment of the invention, the furthermost layer from the film support is the most highly sensitive of three green-sensitive layers, followed, towards the film support, by the green-sensitive layer of moderate sensitivity and then that of the lowest green sensitivity. These are followed by a non-photosensitive layer containing an oxform scavenger and/or a yellow coupler and then at least two blue-sensitive layers, then a layer containing an oxform scavenger or a cyan coupler together with a yellow dye, which is decolourised by the processing process, then three red-sensitive layers in order of high, medium, low sensitivity. In a particularly preferred embodiment, the green-sensitive layers contain a coupler which is colourless before processing but is coloured yellow by the processing process and, by coupling with a colour developer oxidation product, either becomes magenta or alternatively becomes soluble so that this coupling product is removed from the film by the processing. The green-sensitive layers may furthermore contain a coupler which is colourless before processing but is coloured cyan by the processing process and, by coupling with a colour developer oxidation product, either becomes magenta or alternatively becomes soluble.

The photographic materials consist of a support onto which at least one photosensitive silver halide emulsion layer is applied. Thin films and sheets are in particular suitable as supports. A review of support materials and the auxiliary layers applied to the front and reverse sides of which is given in *Research Disclosure* 37254, part 1 (1995), page 285 and in *Research Disclosure* 38957, part XV (1996), page 627.

The substantial constituents of the photographic emulsion layers are the binder, silver halide grains and colour couplers.

Details of suitable binders may be found in *Research Disclosure* 37254, part 2 (1995), page 286 and in *Research Disclosure* 38957, part IIA (1996), page 598.

Details of suitable silver halide emulsions, the production, ripening, stabilisation and spectral sensitisation thereof, including suitable spectral sensitisers, are given in *Research Disclosure* 37254, part 3 (1995), page 286, in *Research Disclosure* 37038, part XV (1995), page 89 and in *Research Disclosure* 38957, part VA (1996), page 603.

Details relating to colour couplers may be found in *Research Disclosure* 37254, part 4 (1995), page 288, in *Research Disclosure* 37038, part II (1995), page 80 and in *Research Disclosure* 38957, part XB (1996), page 616. The maximum absorption of the dyes formed from the couplers and the developer oxidation product is preferably within the following ranges: yellow coupler 430 to 460 nm, magenta coupler 540 to 560 nm, cyan coupler 630 to 700 nm.

In order to improve sensitivity, grain, sharpness and colour separation in colour photographic films, compounds are frequently used which, on reaction with the developer oxidation product, release photographically active compounds, for example DIR couplers which eliminate a development inhibitor.

Details relating to such compounds, in particular couplers, may be found in *Research Disclosure* 37254, part 5 (1995), page 290, in *Research Disclosure* 37038, part XIV (1995), page 86 and in *Research Disclosure* 38957, part XC (1996), page 618.

Colour couplers, which are usually hydrophobic, as well as other hydrophobic constituents of the layers, are conventionally dissolved or dispersed in high-boiling organic solvents. These solutions or dispersions are then emulsified into an aqueous binder solution (conventionally a gelatine solution) and, once the layers have dried, are present as fine droplets (0.05 to 0.8 mm in diameter) in the layers.

Suitable high-boiling organic solvents, methods for the introduction thereof into the layers of a photographic material and further methods for introducing chemical compounds into photographic layers may be found in *Research Disclosure* 37254, part 6 (1995), page 292.

The non-photosensitive interlayers generally located between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in *Research Disclosire* 37254, part 7 (1995), page 292, in *Research Disclosure* 37038, part III (1995), page 84 and in *Research Disclosure* 38957, part XD (1996), page 621.

The photographic material may also contain UV light absorbing compounds, optical brighteners, spacers, filter dyes, formalin scavengers, light stabilisers, anti-oxidants, $D_{min}$ dyes, additives to improve stabilisation of dyes, couplers and whites and to reduce colour fogging, plasticisers (latices), biocides and others.

Suitable compounds may be found in *Research Disclosure* 37254, part 8 (1995), page 292, in *Research Disclosure* 37038, parts IV, V, VI, VII, X, XI and XIII (1995), pages 84 et seq. and in *Research Disclosure* 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in *Research Disclosure* 37254, part 9 (1995), page 294, in *Research Disclosure* 37038, part XII (1995), page 86 and in *Research Disclosure* 38957, part IIB (1996), page 599.

Once exposed with an image, colour photographic materials are processed using different processes depending upon their nature. Details relating to processing methods and the necessary chemicals are disclosed in *Research Disclosure* 37254, part 10 (1995), page 294, in *Research Disclosure* 37038, parts XVI to XXIII (1995), pages 95 et seq. and in *Research Disclosure* 38957, parts XVIII, XIX and XX (1996), pages 630 et seq. together with example materials.

EXAMPLE 1

A colour photographic recording material for colour negative development (Comparison) was produced by applying the following layers in the stated sequence onto a transparent, 120 mm gauge cellulose triacetate film base provided with a coupling layer. Quantities are stated in $g/m^2$. The silver halide application rate is stated as the corresponding quantities of $AgNO_3$. All the silver halide emulsions were stabilised with 0.1 g of 4-hydroxy-6-methyl-1,3,3a,7-tetraazaindene per mole of $AgNO_3$. The silver halide emulsions are characterised by halide composition and, with regard to grain size, by the median particle size by volume (VSP).

| | |
|---|---|
| Layer 1: (Anti-halo layer) | |
| Black colloidal silver | 0.28 |
| UV absorber UV-1 | 0.20 |
| Gelatine | 0.8 |
| Layer 2: (Low sensitivity, red-sensitised layer) | |
| Red-sensitised silver bromide-iodide-chloride emulsion (2.4 mol. % iodide; 10.5 mol. % chloride; VSP 0.35) | 0.85 |
| Gelatine | 0.6 |
| Cyan coupler C-1 | 0.3 |
| Coloured coupler CR-1 | $2.0 \times 10^{-2}$ |
| Coloured coupler CY-1 | $1.0 \times 10^{-2}$ |
| DIR coupler DIR-1 | $1.0 \times 10^{-2}$ |
| Dibutyl phthalate (DBP) | 0.34 |
| Layer 3: (Medium sensitivity, red-sensitised layer) | |
| Red-sensitised silver bromide-iodide emulsion (10.0 mol. % iodide; VSP 0.56) | 1.2 |
| Gelatine | 0.9 |
| Cyan coupler C-1 | 0.2 |
| Coloured coupler CR-1 | $7.0 \times 10^{-2}$ |
| Coloured coupler CY-1 | $3.0 \times 10^{-2}$ |
| DIR coupler DIR-1 | $4.0 \times 10^{-2}$ |
| DBP | 0.34 |
| Layer 4: (High sensitivity, red-sensitised layer) | |
| Red-sensitised silver bromide-iodide emulsion (6.8 mol. % iodide; VSP 1.2) | 1.6 |
| Gelatine | 1.2 |
| Cyan coupler C-2 | 0.15 |
| DIR coupler DIR-3 | $3.0 \times 10^{-2}$ |
| DBP | 0.2 |
| Layer 5: (Interlayer) | |
| Gelatine | 1.0 |
| Layer 6: (Low-sensitivity, green-sensitised layer) | |
| Green-sensitised silver bromide-iodide emulsion | 0.66 |

-continued

| | |
|---|---|
| (9.5 mol. % iodide; 10.4 mol. % chloride; VSP 0.5; compact crystals: V = 20%) | |
| Gelatine | 0.9 |
| Magenta coupler M-1 | 0.3 |
| Coloured coupler MY-1 | $2.0 \times 10^{-2}$ |
| DIR coupler DIR-1 | $5.0 \times 10^{-3}$ |
| DIR coupler DIR-2 | $1.0 \times 10^{-3}$ |
| Oxform scavenger SC-1 | $5.0 \times 10^{-2}$ |
| Tricresyl phosphate (TCP) | 0.2 |
| Layer 7: Medium-sensitivity, green-sensitised layer) | |
| Green-sensitised silver bromide-iodide emulsion (10.0 mol. % iodide; VSP 0.56; compact crystals; V = 20%) | 1.4 |
| Gelatine | 0.9 |
| Magenta coupler M-1 | 0.24 |
| Coloured coupler MY-1 | $4.0 \times 10^{-2}$ |
| DIR coupler DIR-1 | $5.0 \times 10^{-3}$ |
| DIR coupler DIR-2 | $3.0 \times 10^{-3}$ |
| TCP | 0.15 |
| Layer 8: (High-sensitivity, green-sensitised layer) | |
| Green-sensitised silver bromide-iodide emulsion (6.8 mol. % iodide; VSP 1.1; compact and tabular crystals; proportion of tabular crystals in the projected surface area 20%; aspect ratio of tabular crystals 2; V = 28%) | 1.7 |
| Gelatine | 1.2 |
| Magenta coupler M-2 | $3.0 \times 10^{-2}$ |
| Coloured coupler MY-2 | $5.0 \times 10^{-2}$ |
| DIR coupler DIR-3 | $5.0 \times 10^{-2}$ |
| TCP | 0.4 |
| Layer 9: (Interlayer) | |
| Polyvinylpyrrolidone | $10^{-2}$ |
| Gelatine | 0.4 |
| Layer 10: (Yellow filter layer) | |
| Yellow colloidal silver sol | 0.1 |
| Gelatine | 0.8 |
| Layer 11: (Low-sensitivity blue-sensitised layer) | |
| Blue-sensitised silver bromide-iodide emulsion (6.0 mol. % iodide; VSP 0.78) | 0.4 |
| Gelatine | 1.0 |
| Yellow coupler Y-1 | 0.4 |
| DIR coupler DIR-1 | $3.0 \times 10^{-2}$ |
| TCP | 0.2 |
| Layer 12: (Medium-sensitivity, blue-sensitised layer) | |
| Blue-sensitised silver bromide-iodide-chloride emulsion | |
| (8.8 mol. % iodide; 15.0 mol. % chloride; VSP 0.77) | 0.12 |
| (12.0 mol. % iodide; 15.0 mol. % chloride; VSP 1.0) | 0.28 |
| Gelatine | 0.77 |
| Yellow coupler Y-1 | 0.58 |
| TCP | 0.3 |
| Layer 13: (High-sensitivity, blue-sensitised layer) | |
| Blue-sensitised silver bromide-iodide emulsion (12.0 mol. % iodide; VSP 1.2) | 1.2 |
| Gelatine | 0.9 |
| Yellow coupler Y-1 | 0.1 |
| DIR coupler DIR-3 | $2.0 \times 10^{-2}$ |
| TCP | 0.66 |
| Layer 14: (Protective layer) | |
| Micrate silver bromide-iodide emulsion (4.0 mol. % iodide; VSP 0.05) | 0.25 |
| UV absorber UV-2 | 0.2 |
| UV absorber UV-1 | 0.3 |
| Gelatine | 1.4 |
| Layer 16: (Hardening layer) | |
| Gelatine | 0.2 |
| Hardener H-1 | 0.86 |
| Persoftal | 0.04 |

-continued
Compounds used in Example 1:
C-1
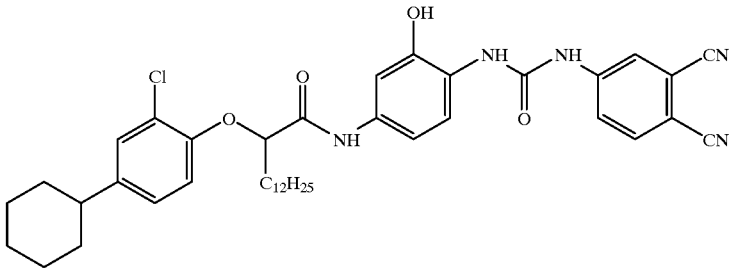
C-2
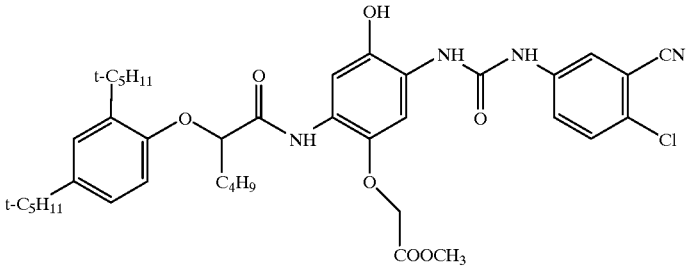
CR-1
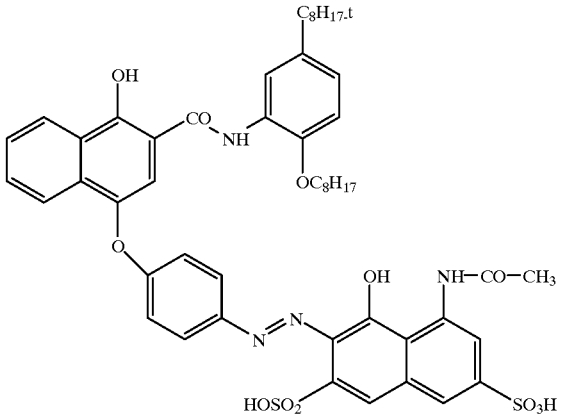
SC-1
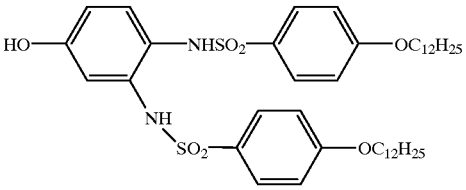

-continued
CY-1
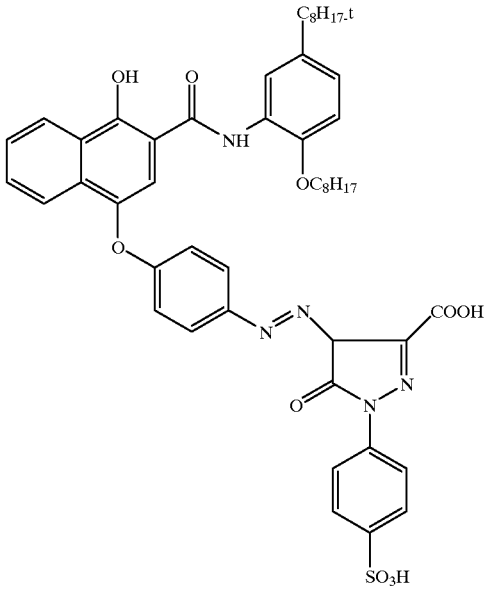
M-1
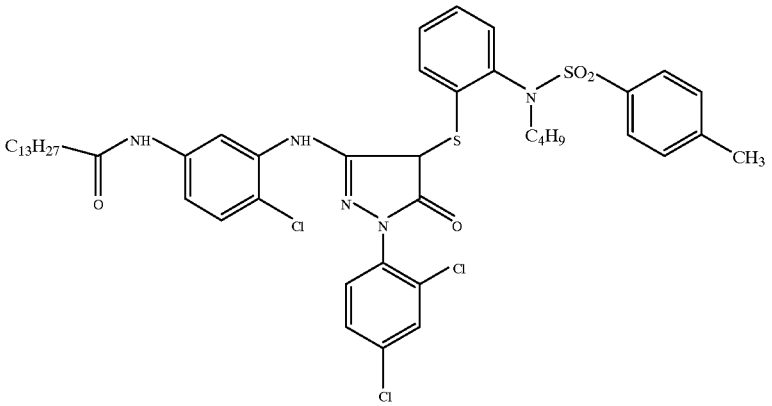
M-2
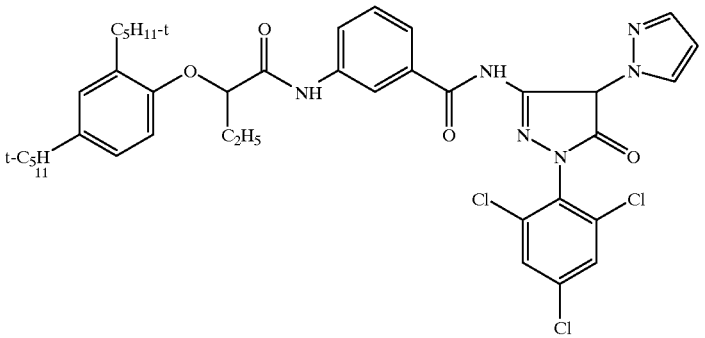

-continued
MY-1
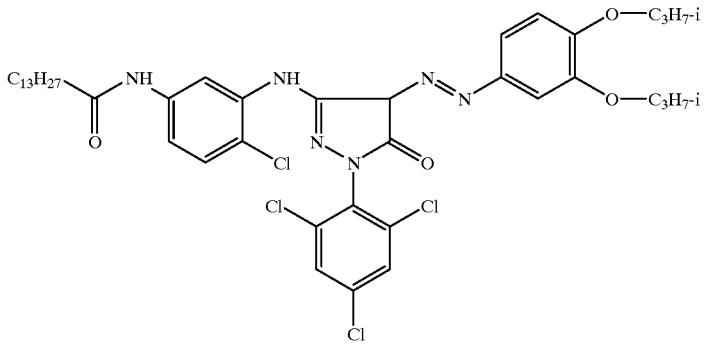
MY-2
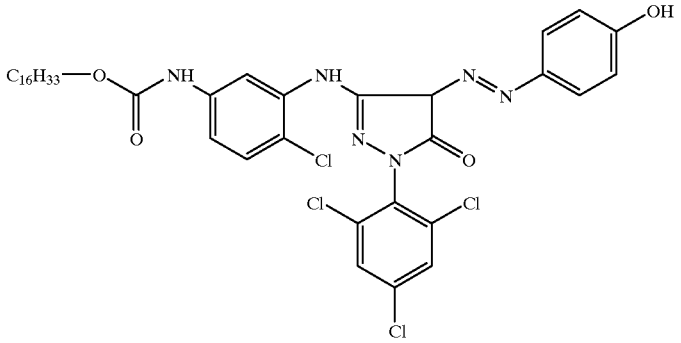
Y-1
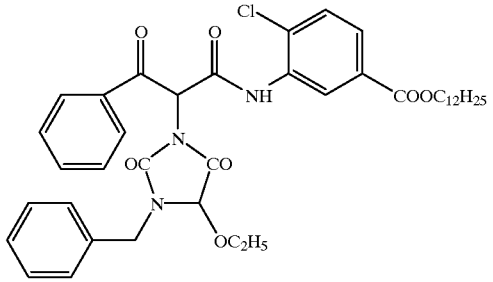
DIR-1
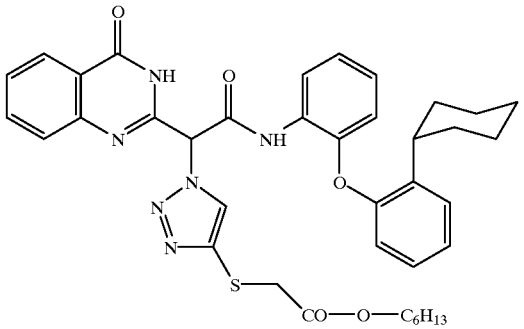

-continued

DIR-2

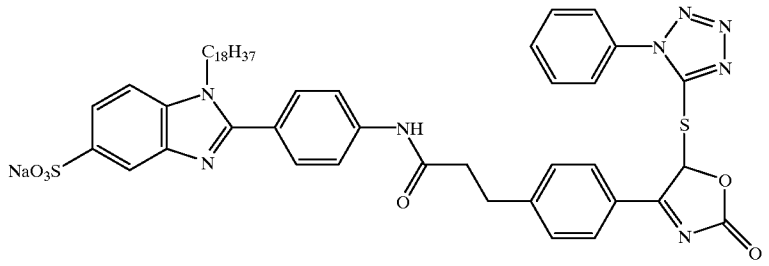

DIR-3

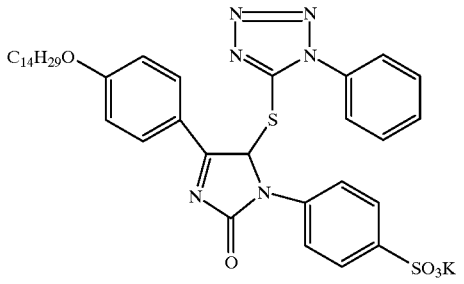

UV-1

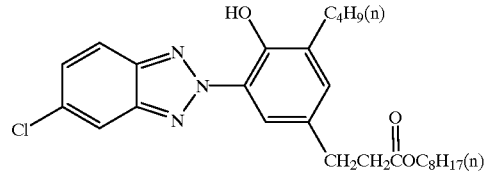

UV-2

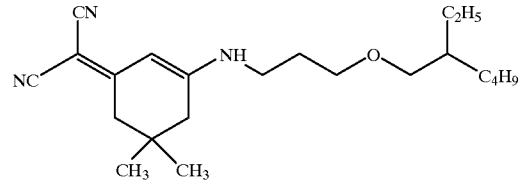

The colourless and coloured couplers were each incorporated with the identical quantity of tricresyl phosphate (TCP) using known prior art emulsification methods.

EXAMPLE 2

The structure was the same as in Example 1; emulsions containing the same quantity of $AgNO_3$, having an identical halide composition and an identical VSP, but having a modified grain habit were used in layers 6, 7 and 8.

Layer 6: predominantly tabular, hexagonal crystals constituting a fraction of the projected surface area of 90%, with an aspect ratio of 6, an adjacent edge ratio of 1:1 to 1.5:1 and V=18%.

Layer 7: predominantly tabular, hexagonal crystals constituting a fraction of the projected surface area of 90%, with an aspect ratio of 7, an adjacent edge ratio of 1:1 to 1.5:1 and V=20%.

Layer 8: predominantly tabular, hexagonal crystals constituting a fraction of the projected surface area of 85%, with an aspect ratio of 7, an adjacent edge ratio of 1:1 to 1.5:1 and V=20%.

EXAMPLE 3

Modified layer sequence but composition of the layers as in Example 1:

Layer 1: Anti-halo layer

Layer 2: Low sensitivity, red-sensitive layer

Layer 3: Medium sensitivity, red-sensitive layer

Layer 4: High sensitivity, red-sensitive layer

Layer 5: Interlayer containing 0.4 g of gelatine/$m^2$ and $10^{-2}$ g of polyvinyl-pyrrolidone/$m^2$ Layer 6: Yellow filter layer Layer 7: Low sensitivity, blue-sensitive layer Layer 8: Medium sensitivity, blue-sensitive layer Layer 9: High sensitivity, blue-sensitive layer Layer 10: Interlayer comprising 1.0 g of gelatine/$m^2$ Layer 11: Low sensitivity, green-sensitive layer Layer 12: Medium sensitivity, green-sensitive layer Layer 13: High sensitivity, green-sensitive layer Layer 14: Protective layer Layer 15: Hardening layer

EXAMPLE 4

Sequence of the layers as in Example 3 with the emulsions of Example 2 in the green-sensitive layer.

The specimens were exposed with daylight through a graduated grey wedge and with a colour test pattern, the Macbeth colour chart. The modulation transfer function of green light at 40 Lp/mm was also measured and perceived visual sharpness determined using a test pattern (Siemens star). The materials were then processed using the processed described by E. Ch. Gehret, *The British J. of Photography,* 1974, page 597.

The following results were obtained:

| Example | | Colour reproduction | MTF 40 Lp/mm 550 nm | Perceived sharpness |
|---|---|---|---|---|
| 1 | Standard | good | 68% | acceptable |
| 2 | Comparison | good | 72% | acceptable |
| 3 | Comparison | poor | 88% | very good |
| 4 | Invention | acceptable | 94% | excellent |

It is evident from the test that the layer arrangement with the green-sensitive layers above the blue-sensitive layers as in Example 3 greatly improves the sharpness of the green sub-image. This is, however, associated with intolerable colour reproduction, namely desaturation of blue, magenta and cyan, giving the images a washed out appearance. This defect is remedied by using the emulsions according to the invention as in Example 4.

What is claimed is:

1. A color photographic film which comprises a support, 2 or 3 red-sensitive, cyan coupling silver halide emulsion layers, 2 or 3 green-sensitive, magenta-coupling silver halide emulsion layers, 2 or 3 blue-sensitive, yellow-coupling silver halide emulsion layers, interlayers and protective layers together with a yellow filter layer arranged closer to the support than the blue-sensitive layers, wherein at least one green-sensitive silver halide emulsion layer is arranged further away from the support than all the other photosensitive layers, and at least 50% of the projected surface area of the silver halide emulsion of the green-sensitive silver halide emulsion layer, of which there is at least one, consists essentially of tabular silver halide grains having an aspect ratio of at least 3.

2. The color photographic film according to claim 1, wherein at least 70% of the projected surface area of the silver halide emulsion of the green-sensitive silver halide emulsion layer, of which there is at least one, consists essentially of tabular silver halide grains having an aspect ratio of at least 5.

3. The color photographic film according to claim 1, wherein the aspect ratio is 5 to 15.

4. The color photographic film according to claim 1, wherein the tabular crystals are substantially hexagonal with an adjacent edge ratio of 1:1 to 2:1.

5. The color photographic film according to claim 1, wherein the tabular crystals have a narrow grain size distribution with a distribution range of ≦25%.

6. The color photographic film according to claim 1, wherein the silver halide emulsion of the green-sensitive silver halide emulsion layer, of which there is at least one, is an AgBrI or AgBrclI emulsion containing up to 15 mol. % AgI and up to 20 mol. % AgCl.

7. The color photographic film according to claim 4, wherein the tabular crystals have a narrow grain size distribution with a distribution range ≦20%.

8. The color photographic film as claimed in claim 1, wherein there are three green-sensitive layers in which the furthest most layer from the film support is the most highly sensitive of the green-sensitive layers, followed, towards the film support by the green-sensitive layer of moderate sensitivity and then the green-sensitive layer of the lowest sensitivity, which is followed by a non-photosensitive layer containing an oxform scavenger and/or a yellow coupler and then at least two blue-sensitive layers and then a layer containing an oxform scavenger or a cyan coupler together with a yellow dye then followed by three red-sensitive layers in the order of high, medium and low sensitivity.

* * * * *

UNITED STATES PATENT AND TRADEMARK OFFICE
CERTIFICATE OF CORRECTION

PATENT NO.: 6,093,524

DATED: JULY 25, 2000

INVENTOR(S): SCHEERER et al.

It is certified that an error appears in the above-identified patent and that said Letters Patent is hereby corrected as shown below:

In claim 6, column 16, line 27, "AgBrclI" should be - -AgBrClI- -.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*